US010981229B2

(12) United States Patent
Suzuki et al.

(10) Patent No.: US 10,981,229 B2
(45) Date of Patent: Apr. 20, 2021

(54) METHOD FOR PRODUCING TIAL-BASED INTERMETALLIC SINTERED COMPACT

(71) Applicants: MITSUBISHI HEAVY INDUSTRIES AERO ENGINES, LTD., Aichi (JP); Osaka Yakin Kogyo Co. Ltd., Osaka (JP)

(72) Inventors: Kenji Suzuki, Tokyo (JP); Kentaro Shindo, Tokyo (JP); Shuntaro Terauchi, Osaka (JP); Hisashi Kitagaki, Osaka (JP); Kazuki Hanami, Osaka (JP); Tadayuki Hanada, Aichi (JP)

(73) Assignees: MITSUBISHI HEAVY INDUSTRIES AERO ENGINES, LTD., Aichi (JP); OSAKA YAKIN KOGYO CO., LTD., Osaka (JP)

( * ) Notice: Subject to any disclaimer, the term of this patent is extended or adjusted under 35 U.S.C. 154(b) by 386 days.

(21) Appl. No.: 16/090,833

(22) PCT Filed: Feb. 28, 2017

(86) PCT No.: PCT/JP2017/007651
§ 371 (c)(1),
(2) Date: Oct. 3, 2018

(87) PCT Pub. No.: WO2017/175515
PCT Pub. Date: Oct. 12, 2017

(65) Prior Publication Data

US 2019/0105713 A1 Apr. 11, 2019

(30) Foreign Application Priority Data

Apr. 5, 2016 (JP) ..... JP2016-075931

(51) Int. Cl.
*B22F 3/16* (2006.01)
*B22F 3/22* (2006.01)
(Continued)

(52) U.S. Cl.
CPC ..... *B22F 3/16* (2013.01); *B22F 3/1017* (2013.01); *B22F 3/225* (2013.01); *C22C 1/00* (2013.01);
(Continued)

(58) Field of Classification Search
CPC ..... B22F 3/16; B22F 3/225; B22F 3/1017; C22C 1/0458; C22C 21/003; C22C 14/00; C22C 1/0416; C22C 1/00; C22C 1/0491
See application file for complete search history.

(56) References Cited

FOREIGN PATENT DOCUMENTS

| | | | |
|---|---|---|---|
| JP | 62-70531 | A | 4/1987 |
| KR | 20040056651 | A | 7/2004 |

OTHER PUBLICATIONS

Office Action for Canadian Application No. 3019654 dated Sep. 25, 2019; 3pp.

*Primary Examiner* — Jessee R Roe
(74) *Attorney, Agent, or Firm* — Hauptman Ham, LLP

(57) ABSTRACT

A method is for producing a TiAl-based intermetallic sintered compact. The method includes mixing Ti powder, Al powder, and a binder to yield a mixture; molding the mixture into a molded product having a predetermined shape with a metal injection molder; placing the molded product in a preliminary sintering die having a storage space inside; performing sintering at a predetermined preliminary sintering temperature to produce a preliminary sintered compact; releasing the preliminary sintered compact from the preliminary sintering die; and performing sintering at a sintering temperature higher than the preliminary sintering temperature to form the TiAl-based intermetallic sintered compact.

6 Claims, 5 Drawing Sheets

(51) Int. Cl.

| | |
|---|---|
| ***C22C 1/00*** | (2006.01) |
| ***C22C 14/00*** | (2006.01) |
| ***C22C 1/04*** | (2006.01) |
| ***B22F 3/10*** | (2006.01) |
| ***C22C 21/00*** | (2006.01) |

(52) U.S. Cl.

CPC ..... *C22C 1/0416* (2013.01); *C22C 1/0458* (2013.01); *C22C 1/0491* (2013.01); *C22C 14/00* (2013.01); *C22C 21/003* (2013.01); *B22F 2301/052* (2013.01); *B22F 2301/205* (2013.01); *B22F 2998/10* (2013.01)

PRELIMINARY SINTERING

SINTERING

METHOD FOR PRODUCING TIAL-BASED INTERMETALLIC SINTERED COMPACT

RELATED APPLICATIONS

The present application is a National Phase of International Application Number PCT/JP2017/007651 filed Feb. 28, 2017 and claims priority based on Japanese Application Number 2016-075931 filed Apr. 5, 2016.

FIELD

The present invention relates to a method for producing a TiAl-based intermetallic sintered compact.

BACKGROUND

A TiAl-based intermetallic compound is an intermetallic compound (alloy) in which Ti (titanium) and Al (aluminum) are bonded and is applied to structures for high-temperature use, such as engines and aerospace instruments, because of its light weight and high strength at high temperatures. The TiAl-based intermetallic compound is difficult to be shaped by forging or casting for its low ductility and other reasons and is sometimes shaped by sintering. Patent Literature 1 discloses that a sintered compact of a TiAl-based intermetallic compound is produced by mixing Ti powder and Al powder and pressure-sintering the mixture.

CITATION LIST

Patent Literature

Patent Literature 1: Japanese Patent Application Laid-open No. 62-70531

SUMMARY

Technical Problem

Unfortunately, for example, when a sintered compact of a TiAl-based intermetallic compound is produced by pressure-sintering, high shape accuracy, for example, a finished shape close to a final product (near net shape), is not achieved because of limitations of apparatuses and molds for pressure-sintering. When the mold shape or the like is designed to increase the shape accuracy, sintered density is reduced.

Therefore, an object of the present invention is to provide a method for producing a TiAl-based intermetallic sintered compact that can suppress reduction of sintered density while improving shape accuracy.

Solution to Problem

To solve the problem described above and achieve the object, a method for producing a TiAl-based intermetallic sintered compact according to the present disclosure includes a mixing step of mixing Ti powder, Al powder, and a binder to yield a mixture; an injection molding step of molding the mixture into a molded product having a predetermined shape with a metal injection molder; a preliminary sintering step of placing the molded product in a preliminary sintering die having a storage space inside and performing sintering at a predetermined preliminary sintering temperature to produce a preliminary sintered compact; and a sintering step of releasing the preliminary sintered compact from the preliminary sintering die and performing sintering at a sintering temperature higher than the preliminary sintering temperature to form the TiAl-based intermetallic sintered compact.

In this method for producing a TiAl-based intermetallic sintered compact, preliminary sintering is performed before sintering in the metal-powder injection molding process. In the preliminary sintering, the molded product is placed in the preliminary sintering die. Therefore, according to this production process, the volume expansion of Ti powder in the solid solution process of Al can be suppressed by the preliminary sintering die, thereby suppressing reduction of sintered density while improving the shape accuracy of the TiAl-based intermetallic sintered compact.

It is preferable that in the method for producing a TiAl-based intermetallic sintered compact, the preliminary sintering step includes forming a solid solution of Al in the Al powder in Ti in the Ti powder, the sintering step includes allowing aggregation of particles of a TiAl-based intermetallic compound formed by bonding Ti and Al dissolved in the Ti, and the preliminary sintering temperature is higher than a temperature at which formation of the solid solution starts and lower than a temperature at which the particles of the TiAl-based intermetallic compound start aggregating. This method for producing a TiAl-based intermetallic sintered compact ensures that Ti powder is kept placed in the preliminary sintering die in the process of volume expansion of Ti powder. Therefore, the production process in the present embodiment can suppress volume expansion of Ti powder and suppress reduction of sintered density while improving the shape accuracy of the TiAl-based intermetallic sintered compact.

It is preferable that in the method for producing a TiAl-based intermetallic sintered compact, the preliminary sintering temperature is equal to or higher than 400° C. and lower than 1400° C. When the preliminary sintering temperature is set to 400° C. or higher, volume expansion of Ti powder can be suppressed by the preliminary sintering die, thereby suppressing reduction of sintered density while improving the shape accuracy of the TiAl-based intermetallic sintered compact. Setting the preliminary sintering temperature to 1400° C. or lower enables appropriate sintering.

It is preferable that in the method for producing a TiAl-based intermetallic sintered compact, the preliminary sintering temperature is equal to or higher than 900° C. Setting the preliminary sintering temperature to 900° C. or higher improves the shape retention when preliminary sintering is finished. Therefore, this method for producing a TiAl-based intermetallic sintered compact enables more appropriate sintering.

It is preferable that in the method for producing a TiAl-based intermetallic sintered compact, the sintering temperature is 1400° C. to 1500° C. In this method for producing a TiAl-based intermetallic sintered compact, sintering at this sintering temperature after preliminary sintering can suppress reduction of sintered density while improving the shape accuracy of the TiAl-based intermetallic sintered compact.

It is preferable that in the method for producing a TiAl-based intermetallic sintered compact, the injection molding step includes injecting the mixture into a mold having a molding space inside to mold the molded product, the storage space having a shape and size substantially equal to the molding space. In this method for producing a TiAl-based intermetallic sintered compact, since the storage space and the mold have substantially the same shape and size, volume expansion of Ti powder can be suppressed appropriately.

Advantageous Effects of Invention

The present invention can suppress reduction of sintered density while improving the shape accuracy of a TiAl-based intermetallic sintered compact.

DESCRIPTION OF EMBODIMENTS

Preferred embodiments of the present invention will be described in detail below with reference to the accompanying drawings. It should be noted that the present invention is not limited by those embodiments and when a plurality of embodiments are provided, the embodiments may be combined.

Figure 1:
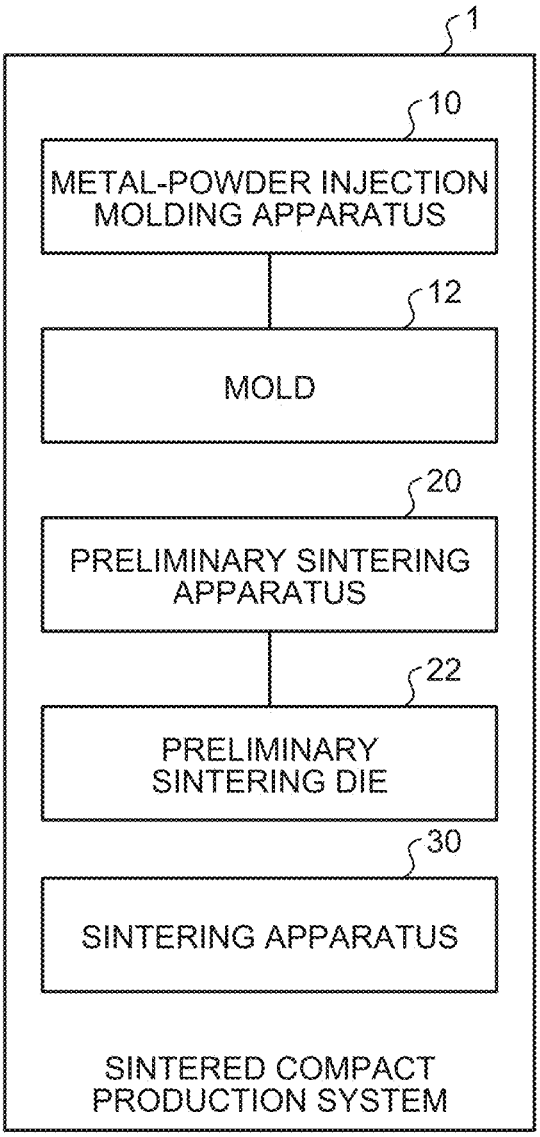
FIG. 1 is a block diagram illustrating a configuration of a sintered compact production system according to the present embodiment.

FIG. 1 is a block diagram illustrating a configuration of a sintered compact production system according to the present embodiment. The sintered compact production system 1 according to the present embodiment is a system for performing a method for producing a sintered compact of a TiAl-based intermetallic compound. The TiAl-based intermetallic sintered compact refers to a sintered compact mainly composed of a TiAl-based intermetallic compound (TiAl-based alloy). The TiAl-based intermetallic compound in the present embodiment is a compound (TiAl, $Ti_3Al$, $Al_3Ti$, and the like) in which Ti (titanium) and Al (aluminum) are bonded. However, the TiAl-based intermetallic compound may be a solid solution of an additional metal M as described later in a TiAl phase, which is a phase in which Ti and Al are bonded.

As illustrated in FIG. 1, the sintered compact production system 1 includes a metal-powder injection molding apparatus 10, a preliminary sintering apparatus 20, and a sintering apparatus 30. The sintered compact production system 1 injects a raw material powder together with a binder into a mold 12 to mold a molded product with the metal-powder injection molding apparatus 10, preliminarily sinters the molded product placed in a preliminary sintering die 22 to produce a preliminary sintered compact with the preliminary sintering apparatus 20, and sinters the preliminary sintered compact with the sintering apparatus 30 to produce a sintered compact of a TiAl-based intermetallic compound (TiAl-based intermetallic sintered compact).

The metal-powder injection molding apparatus 10 is an apparatus that performs metal-powder injection molding (MIM). The metal-powder injection molding apparatus 10 molds a molded product C from a mixture B of raw material powder A and a binder. The raw material powder A contains Ti powder, Al powder, and additional metal powder. Ti powder is powder of Ti (titanium). Al powder is powder of Al (aluminum). The additional metal powder is powder of an additional metal M. The additional metal M is a metal other than Ti and Al and contains, for example, at least one of Nb (niobium), Cr (chromium), and Mn (manganese). When different kinds of metals are used as the additional metal, the additional metal powder may be powder of a single kind that is powder of an alloy of metals or may include different kinds of powders of metals for each metal.

The raw material powder A, that is, Ti powder, Al powder, and additional metal powder, has a particle size of 1 μm to 50 μm, more preferably 1 μm to 20 μm. The raw material powder A contains 20 to 80% by weight of Ti powder, 20 to 80% by weight of Al powder, and 0 to 30% by weight of additional metal powder.

The mixture B is a mixture of the raw material powder A and a binder. The binder binds the raw material powder A and is a resin having flowability. The addition of a binder imparts flowability and moldability to the mixture B.

The metal-powder injection molding apparatus 10 injects the mixture B into the mold 12. The mold 12 is a mold having a molding space that is a space having a predetermined shape in the inside. The mixture B injected into the mold 12 forms a molded product C having the same shape and size as the shape of the molding space. The molded product C has moldability because of the addition of a binder and is kept in the same shape as the shape of the molding space even after being released from the mold 12.

The preliminary sintering apparatus 20 is an apparatus (furnace) that preliminarily sinters the molded product C at a predetermined preliminary sintering temperature to produce a preliminary sintered compact D. The molded product C is released from the mold 12 and placed in the preliminary sintering die 22. The molded product C placed in the preliminary sintering die 22 is placed in the preliminary sintering apparatus 20 and undergoes preliminary sintering to form a preliminary sintered compact D. The preliminary sintering refers to a process of heating the molded product C at a preliminary sintering temperature lower than the sintering temperature described later.

The preliminary sintering die 22 is a die having a storage space that is a space having a predetermined shape in the inside. The preliminary sintering die 22 is made of ceramic such as $Y_2O_3$, $ZrO_2$, and $Al_2O_3$. The storage space of the preliminary sintering die 22 has substantially the same shape and size as the shape and size of the molding space of the mold 12. In other words, the storage space of the preliminary sintering die 22 has substantially the same shape and size as the molded product C. As used herein "substantially the same shape and size" means the same shape and size, except differences such as general dimensional tolerances. However, the internal space of the preliminary sintering die 22 may be larger than the internal space of the mold 12 by 0% to 2%. Although the preliminary sintering die 22 is a die different from the mold 12 in the present embodiment, the preliminary sintering die 22 may be the same as the mold 12. That is, the mold 12 may be used as the preliminary sintering die 22 per se. In this case, the molded product C molded by the metal-powder injection molding apparatus 10 is kept in the mold 12, and the mold 12 serving as the preliminary sintering die 22 is placed in the preliminary sintering apparatus 20 for preliminary sintering.

Figure 2:
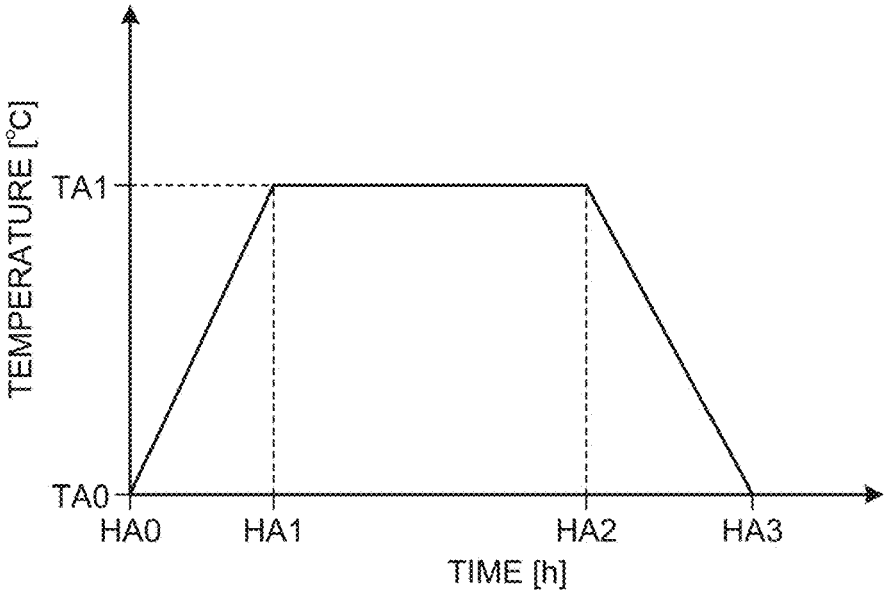
FIG. 2 is a graph illustrating an example of preliminary sintering conditions in the present embodiment.

FIG. 2 is a graph illustrating an example of preliminary sintering conditions in the present embodiment. In FIG. 2, the horizontal axis represents time, and the vertical axis represents temperature inside the preliminary sintering apparatus 20. As illustrated in FIG. 2, the preliminary sintering apparatus 20 accommodates the molded product C placed in the preliminary sintering die 22 in the inside and increases the internal temperature from temperature TA0 to temperature TA1 from time HA0 to time HA1. Temperature TA0 is the temperature at time HA0, that is, at the start of preliminary sintering. Temperature TA0 is room temperature in the present embodiment. However, it may be a temperature lower than the temperature at which degreasing of the binder is started. The temperature at which degreasing of the binder is started is the temperature at which the binder starts thermal decomposition, for example, 300° C. Temperature TA1 is a temperature at time HA1 and a preliminary sintering temperature. Temperature TA1 (preliminary sintering temperature) is higher than the temperature at which particles of the TiAl-based intermetallic compound form necks and start bonding (temperature at which the neck forming process described later starts) and lower than the temperature at which particles of the TiAl-based intermetallic compound starts aggregating (the aggregation process described later). However, temperature TA1 (preliminary sintering temperature) may fall outside of this temperature range, may be higher than the temperature at which Al starts dissolving into Ti powder (the solid solution process described later), and may be lower than the temperature at which particles of the TiAl-based intermetallic compound starts aggregating (the aggregation process described later). Specifically, temperature TA1 is 900° C. or higher to lower than 1400° C. or may be 400° C. or higher to lower than 1400° C. Time HA1 is the time a predetermined time after time HA0, for example, 0.5 hours to 3 hours after time HA0.

As illustrated in FIG. 2, at time HA1 when temperature TA1 (preliminary sintering temperature) is reached, the preliminary sintering apparatus 20 keeps the internal temperature at temperature TA1 until time HA2. Time HA2 is the time a predetermined time after time HA1, for example, 0.5 hours to 10 hours after time HA1. The preliminary sintering apparatus 20 decreases the internal temperature from temperature TA1 to temperature TA0 from time HA2 to time HA3 and terminates the preliminary sintering process. In this way, the preliminary sintering apparatus 20 preliminarily sinters the molded product C placed in the preliminary sintering die 22 at temperature TA1 (preliminary sintering temperature) to produce a preliminary sintered compact D. Time HA3 is the time a predetermined time after time HA2, for example, 0.5 hours to 3 hours after time HA2.

The sintering apparatus 30 is an apparatus (furnace) that sinters the preliminary sintered compact D to produce a TiAl-based intermetallic sintered compact E. The preliminary sintered compact D is released from the preliminary sintering die 22 and placed in the sintering apparatus 30. The sintering apparatus 30 sinters this preliminary sintered compact D at a predetermined sintering temperature to produce a TiAl-based intermetallic sintered compact E.

Figure 3:
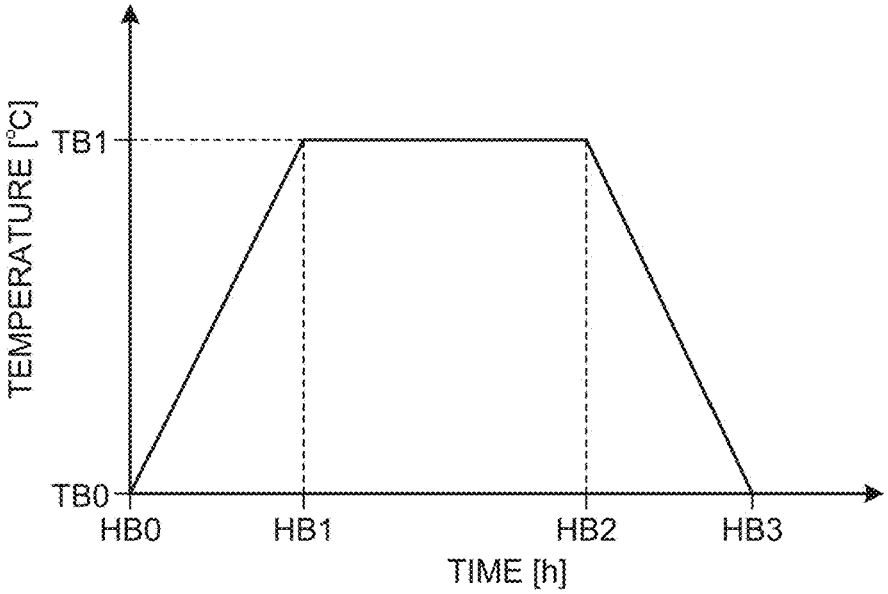
FIG. 3 is a graph illustrating an example of sintering conditions in the present embodiment.

FIG. 3 is a graph illustrating an example of sintering conditions in the present embodiment. In FIG. 3, the horizontal axis represents time, and the vertical axis represents the temperature inside the sintering apparatus 30. As illustrated in FIG. 3, the sintering apparatus 30 accommodates the preliminary sintered compact D released from the preliminary sintering die 22 in the inside and increases the internal temperature from temperature TB0 to temperature TB1 from time HB0 to time HB1. Temperature TB0 is the temperature at time HB0, that is, at the start of sintering. Temperature TB0 is room temperature. The temperature TB1 is the temperature at time HB1 and is sintering temperature. Temperature TB1 (sintering temperature) is a temperature higher than the preliminary sintering temperature, a temperature that allows Ti powder and Al powder to be sintered, that is, the temperature at which necks between powder particles of the TiAl-based intermetallic compound are grown to aggregate (aggregation process described later). Temperature TB1 (sintering temperature) is preferably 1400° C. to 1500° C., more preferably 1420° C. to 1470° C. Time HB1 is the time a predetermined time after time HB0, for example, 0.5 hours to 3 hours after time HB0.

As illustrated in FIG. 3, at time HB1 when temperature TB1 (sintering temperature) is reached, the sintering apparatus 30 keeps the internal temperature at temperature TB1 until time HB2. Time HB2 is the time a predetermined time after time HB1, for example, 0.5 hours to 5 hours after time HB1. The sintering apparatus 30 decreases the internal temperature from TB1 to TB0 from time HB2 to time HB3 and terminates the sintering process. In this way, the sintering apparatus 30 sinters the preliminary sintered compact D released from the preliminary sintering die 22 at temperature TB1 (sintering temperature) to produce a TiAl-based intermetallic sintered compact E. Time HB3 is the time a predetermined time after time HB2, for example, 0.5 hours to 10 hours after time HB2.

Figure 4:
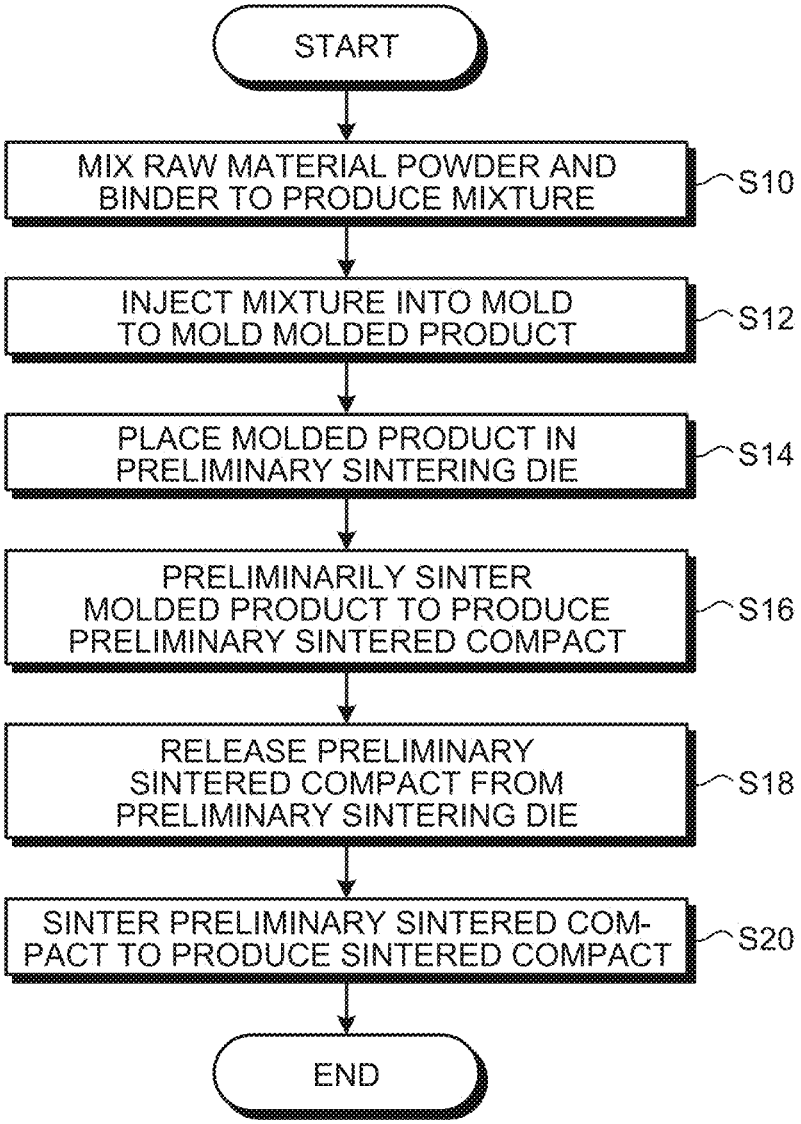
FIG. 4 is a flowchart illustrating a production flow of a TiAl-based intermetallic sintered compact by the sintered compact production system according to the first embodiment.

The production flow of the TiAl-based intermetallic sintered compact E by the sintered compact production system 1 will now be described. FIG. 4 is a flowchart illustrating the production flow of a TiAl-based intermetallic sintered compact by the sintered compact production system according to the first embodiment. As illustrated in FIG. 4, the sintered compact production system 1 mixes raw material powder A with a binder, first, to produce a mixture B (step S10). This process of producing the mixture B may be performed by a machine or may be performed by an operator. After producing the mixture B, the sintered compact production system 1 injection-molds the mixture B in the mold 12 with the metal-powder injection molding apparatus 10 to mold a molded product C (step S12). After molding the molded product C, the sintered compact production system 1 places the molded product C in the preliminary sintering die 22 (step S14) and preliminarily sinters the molded product C placed in the preliminary sintering die 22 with the preliminary sintering apparatus 20 to produce a preliminary sintered compact D (step S16). After producing the preliminary sintered compact D, the sintered compact production system 1 releases the preliminary sintered compact D from the preliminary sintering die 22 (step S18) and sinters the preliminary sintered compact D released from the preliminary sintering die 22 with the sintering apparatus 30 to produce a TiAl-based intermetallic sintered compact E (step S20). This process ends upon production of the TiAl-based intermetallic sintered compact E.

The raw material powder A contains Ti powder and Al powder. When the molded product C composed of such raw material powder A is sintered, Al dissolves and diffuses in the Ti powder (Ti phase) due to what is called the Kirkendall effect to produce TiAl-based intermetallic compound powder. The TiAl-based intermetallic compound powder particles form necks to be bonded (fused) to produce a TiAl-based intermetallic sintered compact E. When Al dissolves and diffuses in Ti powder, Ti powder particles become bigger, so that the center-to-center distance between Ti powder particles increases. This results in volume expansion. Therefore, when the raw material powder A is sintered, volume expansion occurs to make it difficult to keep the shape, and it is difficult to improve the shape accuracy. As sintering proceeds, the volume expands and then shrinks to produce the TiAl-based intermetallic sintered compact E.

Once the volume expands, the ultimate sintered density decreases after shrinkage. In particular, when the metal-powder injection molding process is used, it is necessary to perform sintering while keeping the molded shape. However, this volume expansion makes it particularly difficult to keep the molded shape. The sintered compact production system 1 according to the present embodiment performs preliminary sintering in the preliminary sintering die 22 before sintering, thereby suppressing volume expansion, improving the shape accuracy, and suppressing reduction in sintered density. The present embodiment is compared with a comparative example below.

Figure 5:
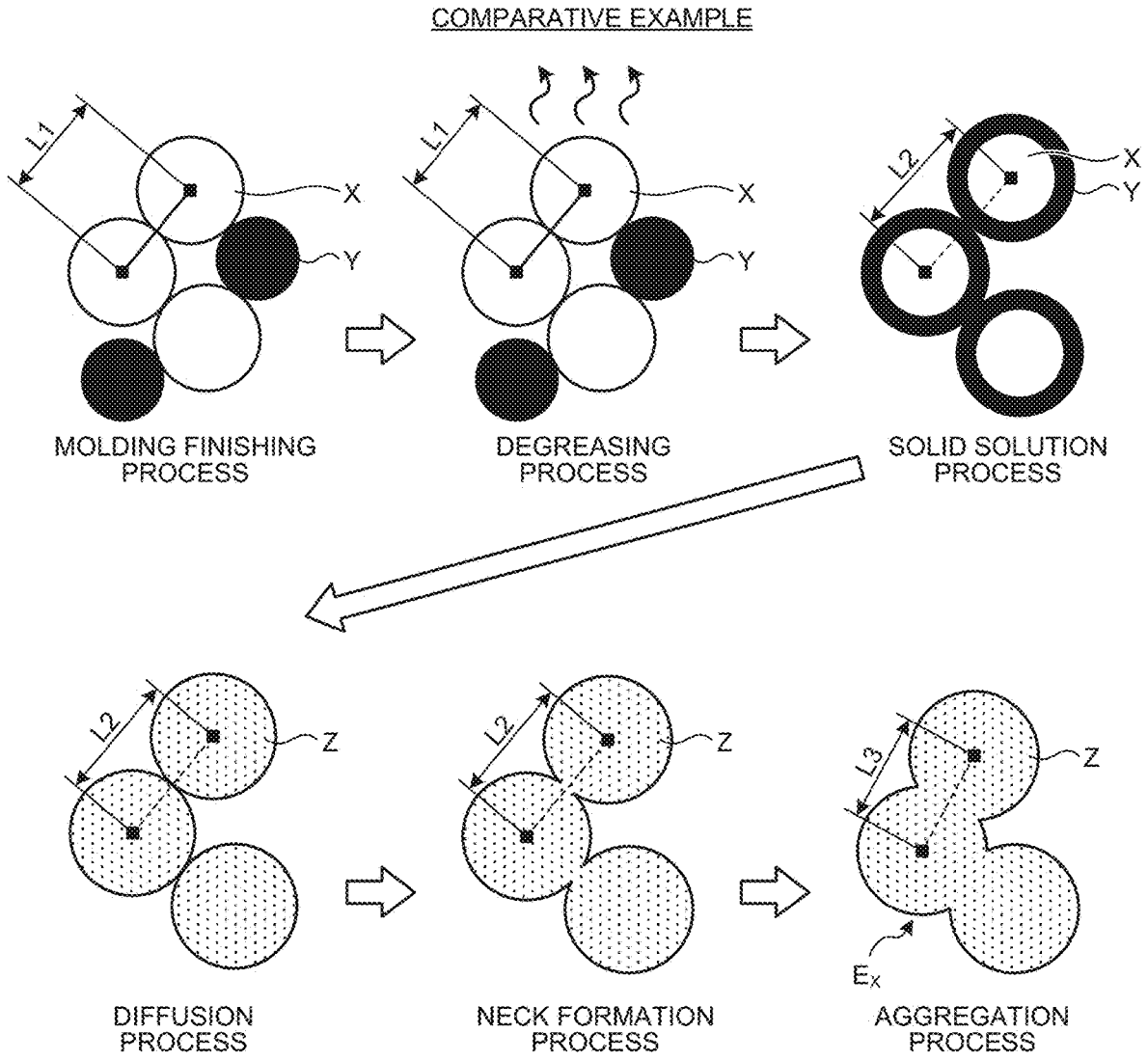
FIG. 5 is a diagram illustrating a sintering process according to a comparative example.

FIG. 5 is a diagram illustrating a sintering process according to a comparative example. In the comparative example, a TiAl-based intermetallic sintered compact $E_X$ is produced by degreasing and sintering the molded product C without performing preliminary sintering. In the following description, Ti powder is referred to as Ti powder particle X, Al powder is referred to as Al powder particle Y, and the TiAl-based intermetallic compound powder is referred to as TiAl-based intermetallic compound powder particle Z. In the following description, a description of additional metal powder is not given. As illustrated in FIG. 5, in a molding finishing process, Ti powder particles X and Al powder particles Y form the molded product C. The molding finishing process is subsequent to molding of the molded product C by metal-powder injection molding and before sintering is started. The center-to-center distance between Ti powder particles X in the molding finishing process is L1.

In the comparative example, the molded product C is heated and sintered without being put into a die such as the preliminary sintering die 22. The molded product C, when heated, undergoes a degreasing process of degreasing the binder, first. In the degreasing process, the binder is degreased and only Ti powder particles X and Al powder particles Y are left. In the degreasing process, Ti powder particles X have not yet reacted with Al powder particles Y, and therefore the center-to-center distance between Ti powder particles X remains L1. As the temperature further increases, the degreasing process moves on to the solid solution process. In the solid solution process, Al in Al powder covers the periphery of Ti powder particles X and starts dissolving in Ti powder particles X. In this solid solution process, Al covers the periphery of Ti powder particles X and dissolve in Ti powder particles X. Therefore, the Ti powder particles X become bigger and the center-to-center distance between Ti powder particles X becomes L2 greater than L1. Accordingly, in the solid solution process, volume expansion as a whole occurs and the volume is larger than the molded product C. As the temperature further increases, the solid solution process moves on to the diffusion process. In the diffusion process, Al dissolved in Ti powder particles X (Ti phase) diffuses to yield TiAl-based intermetallic compound powder particles Z. The center-to-center distance between TiAl-based intermetallic compound powder particles Z in the diffusion process remains L2.

The diffusion process is followed by the neck formation process. In the neck formation process, TiAl-based intermetallic compound powder particles Z form a neck and starts bonding. In the neck formation process, although neck formation starts, necks are not yet grown (aggregate), and the center-to-center distance between TiAl-based intermetallic compound powder particles Z remains L2. The neck formation process is followed by the aggregation process. In the aggregation process, the necks formed between TiAl-based intermetallic compound powder particles Z are grown, and TiAl-based intermetallic compound powder particles Z aggregate to produce a TiAl-based intermetallic sintered compact E. In the aggregation process, the distance between TiAl-based intermetallic compound powder particles Z decreases and the center-to-center distance between TiAl-based intermetallic compound powder particles Z becomes L3 smaller than L2.

Figure 6:
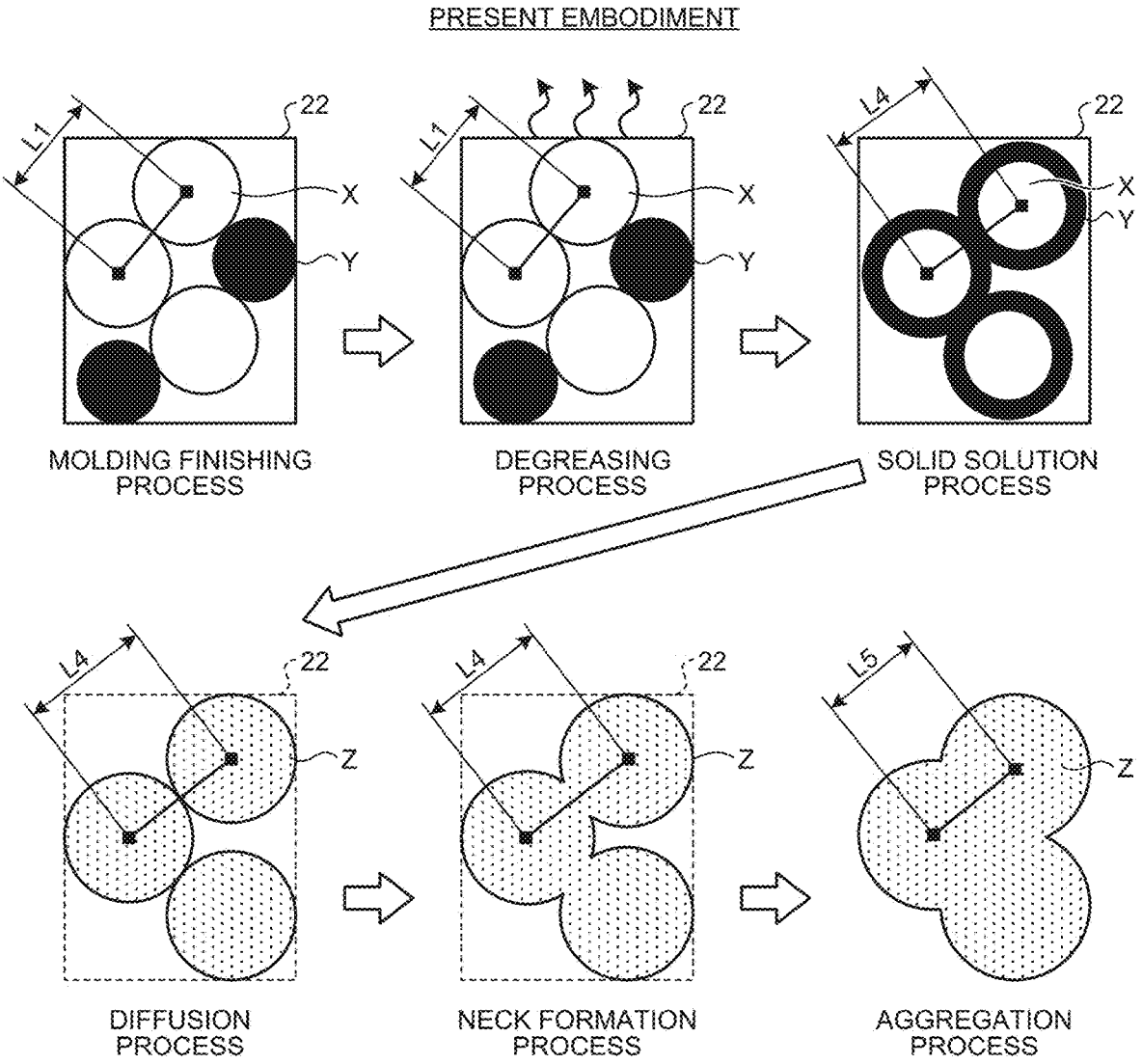
FIG. 6 is a diagram illustrating a preliminary sintering process and a sintering process according to the present embodiment.

The present embodiment will now be described. FIG. 6 is a diagram illustrating the preliminary sintering process and the sintering process according to the present embodiment. In the present embodiment, at least the degreasing process and the solid solution process are performed in the preliminary sintering, and at least the aggregation process is performed in the sintering process. In the present embodiment, first of all, the molded product C is placed in the preliminary sintering die 22 to undergo preliminary sintering. In the present embodiment, the molding finishing process takes place after the molded product C is placed in the preliminary sintering die 22 and before preliminary sintering is started. The molded product C placed in the preliminary sintering die 22 is heated to a preliminary sintering temperature and initially undergoes the degreasing process of degreasing the binder to leave only Ti powder particles X and Al powder particles Y. The center-to-center distance between Ti powder particles X in the molding finishing process and the degreasing process is L1. The degreasing process takes place, for example, when the temperature is increased to 300° C. or higher.

As the temperature further increases, the degreasing process moves on to the solid solution process. The solid solution process takes place, for example, when the temperature is heated to 400° C. or higher. In the solid solution process, Al in Al powder covers the periphery of Ti powder particles X and starts dissolving in the Ti powder particles X. In this solid solution process, Ti powder particles X attempt to expand but the preliminary sintering die 22 having substantially the same shape as the molded product C suppresses the expansion and keeps substantially the same shape as the molded product C. In the solid solution process in the present embodiment, the expansion of Ti powder particles X is suppressed more than the comparative example, and therefore the center-to-center distance L4 between Ti powder particles X is smaller than the distance L2 in the comparative example. That is, in the present embodiment, the volume expansion in the solid solution process is suppressed.

As the temperature further increases, the solid solution process moves on to the diffusion process. In the diffusion process, Al dissolved in Ti powder particles X (Ti phase) diffuses (bonds) to produce TiAl-based intermetallic compound powder particles Z. The center-to-center distance between TiAl-based intermetallic compound powder particles Z in the diffusion process remains L4. As the temperature further increases, the diffusion process moves on to the neck formation process. The neck formation process takes place, for example, when the temperature is increased to 900° C. or higher. In the neck formation process, the TiAl-based intermetallic compound powder particles Z form necks and start bonding. In the neck formation process, although neck formation has started, necks are not yet grown (aggregate), and therefore the center-to-center distance between TiAl-based intermetallic compound powder particles Z remains L4. In the present embodiment, up to the neck formation process is included in the preliminary sintering process. However, the preliminary sintering process, that is, the process of placement in the preliminary sintering die 22 is at any time at least before the solid solution process in which volume expansion occurs. In other words, in the preliminary sintering process, TiAl-based intermetallic compound powder particles Z may not be produced as long as formation of the solid solution of Al (volume expansion) is finished. The preliminary sintering process may include part of the aggregation process, that is, up to the process in which the aggregation process is not completed but the aggregation process has started to some extent.

In the present embodiment, the preliminary sintering process is finished in the diffusion process and moves on to the sintering process. That is, after the diffusion process is finished, the preliminary sintered compact D is released from the preliminary sintering die 22 and sintering is performed at a sintering temperature. When the temperature is increased to the sintering temperature, the aggregation process takes place. The aggregation process occurs, for example, when the temperature is increased to 1400° C. or higher. In the aggregation process, the necks between TiAl-based intermetallic compound powder particles Z are grown, so that TiAl-based intermetallic compound powder particles Z aggregate to produce the TiAl-based intermetallic sintered compact E. In the aggregation process, the distance between TiAl-based intermetallic compound powder particles Z decreases, and the center-to-center distance between TiAl-based intermetallic compound powder particles Z becomes L5 smaller than L4. In the present embodiment, since the volume expansion of Ti powder particles X is suppressed, the distance L5 is smaller than the distance L3 in the TiAl-based intermetallic sintered compact $E_x$ in the comparative example. In the TiAl-based intermetallic sintered compact E according to the present embodiment, since the volume expansion of Ti powder particles X is suppressed, the shape change from the molded product C is smaller than in the comparative example, thereby improving the shape accuracy. Further, in the TiAl-based intermetallic sintered compact E according to the present embodiment, since the volume expansion of Ti powder particles X is suppressed, reduction of sintered density is suppressed, as indicated by the distance L5 smaller than the distance L3.

As described above, the method for producing the TiAl-based intermetallic sintered compact E by the sintered compact production system 1 in the present embodiment includes a mixing step, an injection molding step, a preliminary sintering step, and a sintering step. The mixing step mixes Ti powder, Al powder, and a binder to yield a mixture B. The injection molding step molds the mixture B into a molded product C having a predetermined shape with a metal injection molder. The preliminary sintering step places the molded product C in the preliminary sintering die 22 having a storage space in the inside and performs sintering at a predetermined preliminary sintering temperature to produce a preliminary sintered compact D. The sintering step releases the preliminary sintered compact D from the preliminary sintering die 22 and performs sintering at a sintering temperature higher than the preliminary sintering temperature to form a TiAl-based intermetallic sintered compact E.

In the method for producing the TiAl-based intermetallic sintered compact E in the present embodiment, in which Ti powder and Al powder are mixed and subjected to metal-powder injection molding to produce the TiAl-based intermetallic sintered compact E, preliminary sintering is performed before sintering. In the preliminary sintering, the molded product C is placed in the preliminary sintering die 22. Therefore, according this production process, the volume expansion of Ti powder particles X in the solid solution process of Al can be suppressed by the preliminary sintering die 22. This process can suppress reduction of the sintered density while improving the shape accuracy of the TiAl-based intermetallic sintered compact E.

In the method for producing the TiAl-based intermetallic sintered compact E in the present embodiment, the preliminary sintering step forms a solid solution of Al in Al powder in Ti in Ti powder (solid solution process). The sintering step allows aggregation of the particles of the TiAl-based intermetallic compound formed by bonding Ti and Al dissolved in Ti (aggregation process). The preliminary sintering temperature is higher than the temperature at which formation of a solid solution of Al starts (the temperature at which the solid solution process of Al starts) and lower than the temperature at which the particles in the TiAl-based intermetallic compound starts aggregating (temperature at which the aggregation process starts). Accordingly, the production process in the present embodiment ensures that Ti powder particles X are kept placed in the preliminary sintering die 22 in the solid solution process of Al, that is, the process in which the volume expansion of Ti powder particles X takes place. The production process in the present embodiment thus can suppress volume expansion of Ti powder particles X and suppress reduction of sintered density while improving the shape accuracy of the TiAl-based intermetallic sintered compact E.

The preliminary sintering temperature is 400° C. or higher to lower than 1400° C. Since the solid solution process of Al starts from about 400° C., the preliminary sintering temperature is set to 400° C. or higher, so that the volume expansion of Ti powder particles X is suppressed by the preliminary sintering die 22, thereby suppressing reduction of sintered density while improving the shape accuracy of the TiAl-based intermetallic sintered compact E. Since the aggregation process may start beyond 1400° C., the preliminary sintering temperature is set to 1400° C. or lower, so that sintering can be performed appropriately.

Preferably, the preliminary sintering temperature is 900° C. or higher to lower than 1400° C. Since the neck formation process of the TiAl-based intermetallic compound powder particles Z starts at 900° C. or higher, at least part of the TiAl-based intermetallic compound powder particles Z are bonded through neck formation when the preliminary sintering is finished. This improves the shape retention at the release from the preliminary sintering die 22. Therefore, setting the preliminary sintering temperature to 900° C. or higher to lower than 1400° C. enables more appropriate sintering.

Preferably, the sintering temperature is 1400° C. to 1500° C. Sintering at this sintering temperature after preliminary sintering can suppress reduction of the sintered density while improving the shape accuracy of the TiAl-based intermetallic sintered compact E.

The injection molding step injects the mixture B into the mold 12 having a molding space in the inside to form a molded product C. The shape and size of the storage space of the preliminary sintering die 22 is substantially the same as the molding space of the mold 12. Since the preliminary sintering die 22 has substantially the same shape and size as the mold 12, the volume expansion of the Ti powder particles X is suppressed appropriately. The production process according to the present embodiment thus can suppress reduction of the sintered density while improving the shape accuracy.

Although embodiments of the present invention have been described above, embodiments are not intended to be limited by the specifics of these embodiments. The components above include those easily conceived by those skilled in the art, those substantially identical, and equivalents.

Furthermore, the components above can be combined as appropriate. The components can be omitted, replaced, or modified in various ways without departing from the spirit of the foregoing embodiments.

REFERENCE SIGNS LIST

1 Sintered compact production system
10 Metal-powder injection molding apparatus
12 Mold
20 Preliminary sintering apparatus
22 Preliminary sintering die
30 Sintering apparatus
A Raw material powder
B Mixture
C Molded product
D Preliminary sintered compact
E TiAl-based intermetallic sintered compact
X Ti powder particle
Y Al powder particle
Z TiAl-based intermetallic compound powder particle

The invention claimed is:

1. A method for producing a TiAl-based intermetallic sintered compact, the method comprising:

mixing Ti powder, Al powder, and a binder to yield a mixture;

molding the mixture into a molded product having a predetermined shape with a metal injection molder;

placing the molded product in a preliminary sintering die having a storage space inside;

performing sintering at a predetermined preliminary sintering temperature to produce a preliminary sintered compact;

releasing the preliminary sintered compact from the preliminary sintering die; and performing sintering at a sintering temperature higher than the preliminary sintering temperature to form the TiAl-based intermetallic sintered compact.

2. The method for producing a TiAl-based intermetallic sintered compact according to claim 1, wherein the performing sintering to produce the preliminary sintered compact includes forming a solid solution of Al in the Al powder in Ti in the Ti powder, the performing sintering to form the TiAl-based intermetallic sintered compact includes allowing aggregation of particles of a TiAl-based intermetallic compound formed by bonding Ti and Al dissolved in the Ti, and the preliminary sintering temperature is higher than a temperature at which formation of the solid solution starts and lower than a temperature at which the particles of the TiAl-based intermetallic compound start aggregating.

3. The method for producing a TiAl-based intermetallic sintered compact according to claim 2, wherein the preliminary sintering temperature is equal to or higher than 400° C. and lower than 1400° C.

4. The method for producing a TiAl-based intermetallic sintered compact according to claim 3, wherein the preliminary sintering temperature is equal to or higher than 900° C.

5. The method for producing a TiAl-based intermetallic sintered compact according to claim 3, wherein the sintering temperature is 1400° C. to 1500° C.

6. The method for producing a TiAl-based intermetallic sintered compact according to claim 1, wherein the molding includes injecting the mixture into a mold having a molding space inside to mold the molded product, the storage space having a shape and size substantially equal to the molding space.

* * * * *